US005102363A

United States Patent [19]

Koizumi

[11] Patent Number: 5,102,363

[45] Date of Patent: Apr. 7, 1992

[54] MANUFACTURING METHOD OF INDIRECTLY HEATED CATHODE

[75] Inventor: Sachio Koizumi, Mobara, Japan

[73] Assignee: Hitachi, Ltd., Tokyo, Japan

[21] Appl. No.: 838,715

[22] Filed: Mar. 12, 1986

[30] Foreign Application Priority Data

Mar. 18, 1985 [JP] Japan ..... 60-52203

[51] Int. Cl.[5] ..... H01J 9/12

[52] U.S. Cl. ..... 445/36; 427/111

[58] Field of Search ..... 445/36, 13, 17, 46; 427/111, 124, 126.3

[56] References Cited

U.S. PATENT DOCUMENTS

| | | | |
|---|---|---|---|
| 3,170,772 | 2/1965 | Sato | 427/111 |
| 3,691,421 | 9/1972 | Decker | 427/111 |
| 3,765,939 | 10/1973 | Reid | 427/111 |
| 4,009,409 | 2/1977 | Buescher et al. | 427/77 |
| 4,126,489 | 11/1978 | Williams | 427/111 |

FOREIGN PATENT DOCUMENTS

| | | | |
|---|---|---|---|
| 0006761 | 1/1979 | Japan | 445/36 |
| 844783 | 8/1960 | United Kingdom . | |
| 947999 | 1/1964 | United Kingdom . | |
| 994471 | 6/1965 | United Kingdom . | |
| 1004776 | 9/1965 | United Kingdom . | |
| 1349128 | 3/1974 | United Kingdom . | |
| 2012474 | 7/1979 | United Kingdom . | |
| 1576183 | 10/1980 | United Kingdom . | |

*Primary Examiner*—Kurt Rowan

*Attorney, Agent, or Firm*—Antonelli, Terry, Stout & Kraus

[57] ABSTRACT

The present invention relates to the manufacturing method of an indirectly heated cathode comprising the formation of a black film on the internal surface of a cathode sleeve, which contains a reducing material, the black film being formed by heat reduction of a thin film of a metal oxide, which has previously been formed on the internal surface of the cathode sleeve. The indirectly heated cathode manufactured by this method has shorter emission warm up time for the emission of electrons and lower power consumption compared with those manufactured by conventional methods.

18 Claims, 2 Drawing Sheets

MANUFACTURING METHOD OF INDIRECTLY HEATED CATHODE

BACKGROUND OF INVENTION

The present invention relates to a manufacturing method of an indirectly heated cathode to be used as an electron tube such as a cathode ray tube. When using an indirectly heated cathode as cathode ray tubes, such as a picture tube of a television or a display tube of an information processing apparatus, it is desired that the time required for the appearance of the picture on the display screen from the time of switching on, due to the thermoelectronic emission caused by the rise of temperature of the cathode, be reduced as far as possible.

An indirectly heated cathode is described in Japanese Patent Laid Open No. 51-50564, wherein the cathode has a structure which includes a cap having thermoelectronic emission material adhered thereto, covering the top of the cathode sleeve and a heater inserted into the inside of the cathode sleeve used to heat the thermoelectronic emission material. In this indirectly heated cathode the emission warm up time of the thermoelectronic emission can be reduced by providing the black coating on both the internal and external surfaces of the sleeve.

When the black coatings are provided on both the internal and the external surfaces of the cathode sleeve, however, the radiation of the heat from the external surface of the cathode sleeve increases thereby causing an increase in the power consumption of the cathode tube. The increase in the power consumption by the cathode system causes an increase in temperature in the electron tube, which results in a thermal transformation of the electrodes, the occurrence of stray emission due to the rise of temperatures of the parts of the electrodes and deterioration of the electron tube as the whole.

When no black coatings are provided to either the internal or the external surfaces of the cathode sleeve, therefore eliminating the aforementioned adverse effects, a decrease in the efficiency, at which the internal surface of the cathode sleeve absorbs the heat radiation from the heater, occurs, resulting in an increase in the emission warm up time of the thermoelectronic emission.

Thus, in order to obtain an indirectly heated cathode with small power consumption and short emission warm up time of the thermoelectronic emission, the black coating should be provided only on the internal surface (on the side of the heater) of the cathode sleeve.

Examples of electron tubes to which black coating is applied only to the internal surface of the cathode sleeve, are described below. To enable the realization of a low-power-consumption indirectly heated cathode a dual cathode sleeve is described in Japanese Patent Laid Open No. 53-145464. However this technique is disadvantageous due to an increase in the number of parts and assembly steps needed. This causes not only an increase in the thermal capacity of the cathode sleeve itself, and a resultant increase in the emission warm up time of the thermoelectronic emission, but also an increase in the production cost. One method for providing the black coating only to the internal surface of the cathode sleeve without using a dual construction for the cathode sleeve, is to provide black coatings to both the internal and the external surfaces of the cathode sleeve by an ordinary process (For example, heat treatment in wet hydrogen), then to remove the black coating on the external surface by barrel finishing. However, this method has a disadvantage in the possibility of having the cathode sleeve deformed during the barrel finishing, thus adversely affecting the quality control of the manufacturing process. As proposed in Japanese Patent Laid Open No. 48-66968, there is a method featuring the deposit of tungsten powder on both the internal and the external surfaces of the cathode sleeve for facilitating the absorption of heat. However this method has the disadvantage of requiring firing of the dried coating of the tungsten suspension in a reducing atmospher, which is a drawback to mass production efficiency. Further as stated previously, having the black coating on both the internal and the external surfaces of the cathode sleeve causes not only an increase in power consumption but also the occurrence of stray emission which results in deterioration of the characteristics of the electron tube. Moreover, the method proposed in said Japanese Patent Laid Open No. 48-66968 includes spraying the mixture of tungsten and aluminium oxide, and firing the coating in a reducing atmosphere to form the black coating. Therefore there is a possibility that the black coating will be exfoliated due to contact of the black coating with the heater inserted in the cathode sleeve and the thermal stress caused by the repetition of the on-off action. Also, the electron tube manufactured by this method has the disadvantages that the electron tube will have a large thermal capacity due to the black coating having a thickness of more than several micrometers, with a resultant increase in the emission warm up time, and a reduction in design allowance, since a reduction in the inside diameter of the cathode sleeve will require a reduction in the size of the heater to be inserted into the cathode sleeve.

SUMMARY OF THE INVENTION

The present invention has been made in consideration of the aforementioned disadvantageous of the prior art, the object of the present invention is to provide a manufacturing method for an indirectly heated cathode eliminating the problems of the conventional manufacturing methods, and having low power consumption and shorter emission warm up time of thermoelectronic emission.

In order to accomplish the above purposes, the present invention features a cathode sleeve made from a material containing a reducing material such as Cr, a process for depositing an oxide, such as the tungsten oxide, on internal surface of the cathode sleeve, for increasing the emissivity of the internal surface by reducing the oxide and a process for reducing the oxide using the reducing material.

The present inventor has found that it is possible to increase the emissivity (thus, the absorption activity) of only the internal surface of the cathode sleeve by artificially forming a combination of the oxide and the reducing material or metal. The combination has large thermal emissivity since the cathode sleeve is raised to high temperature, and the chemical reactions such as the oxidation and the reduction progress rapidly. More specifically, the present inventor has discovered a method for forming a film of a metal and an oxide which is stable both mechanically and thermally, including reducing the metal oxides, deposited on the internal surface of the cathode sleeve, using the reducing material included in the material of the cathode sleeve.

DESCRIPTION OF PREFERRED EMBODIMENTS

The present invention will be explained in detail with reference to the drawings figures described above.

Figure 1:
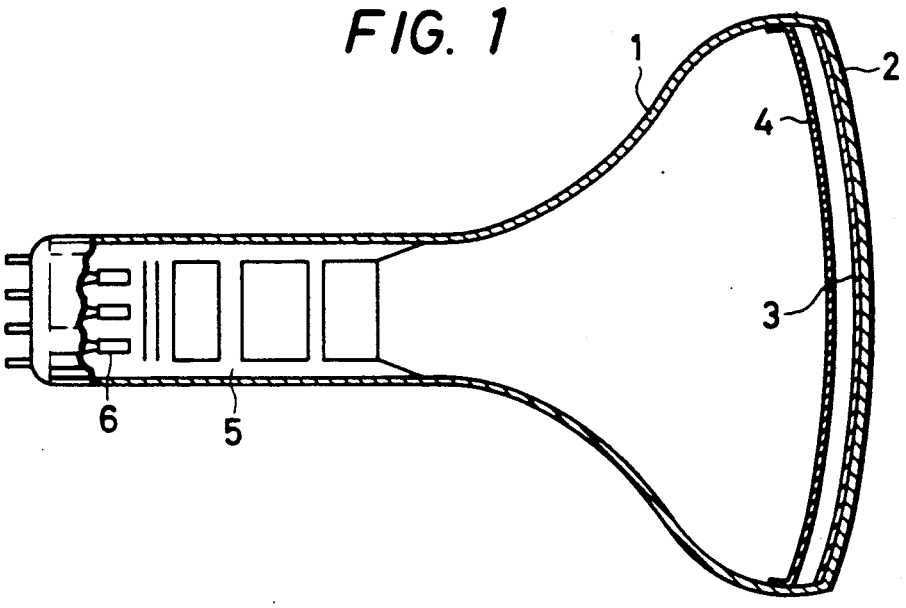
FIG. 1 is a cross-sectional plan view of an exemplified cathode ray tube using an indirectly heated cathode manufactured by the method of the present invention.

FIG. 1 is a cross-sectional plan view of a main member of an exemplified color picture tube using a indirectly heated cathode manufactured by the method of the present invention. This figure shows valve 1, face plate 2, phosphor screen 3, shadow mask 4, electron gun 5 and indirectly heated cathode 6. The construction of one cathode 6, is shown in detail in FIG. 2. Three indirectly heated cathodes 6, arranged in a line constitute a part of the electron gun.

Figure 2:
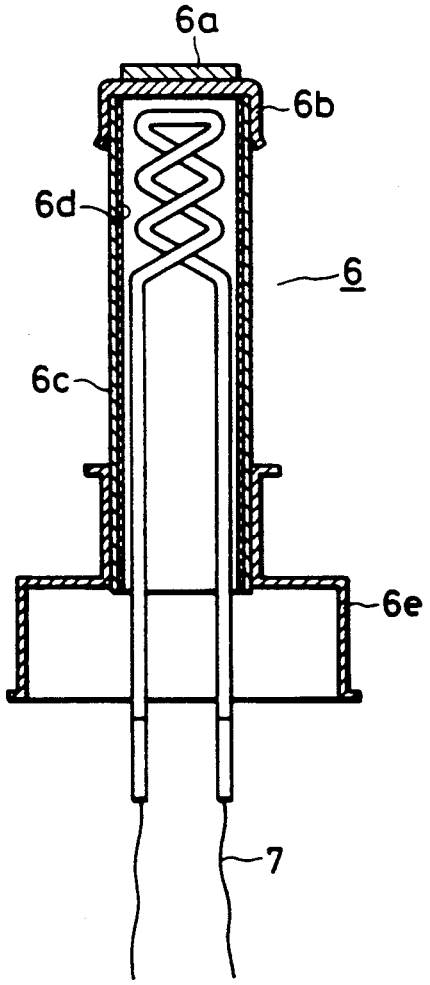
FIG. 2 is a cross-sectional plan view of a main member of an exemplified indirectly heated cathode manufactured by the method of the present invention.

FIG. 2 is a cross-sectional plan view of a main member of an exemplified indirectly heated cathode manufactured by the method of the present invention showing the indirectly heated cathode 6 consisting essentially of cap **6*b* whose top is covered with an electron emissive material 6*a*, cathode sleeve 6*c*, black coating 6*d* of less than $10^5$ Å thick formed on the internal surface of the cathode sleeve 6*c* and disk 6*e*. The cap 6*b* is fixed to one end of the cathode sleeve 6*c* and the disk 6*e* is fixed to the other end of the cathode sleeve 6*c*. Heater 7 is installed in the indirectly heated cathode 6** to emit desired thermoelectrons by heating.

Figure 3:
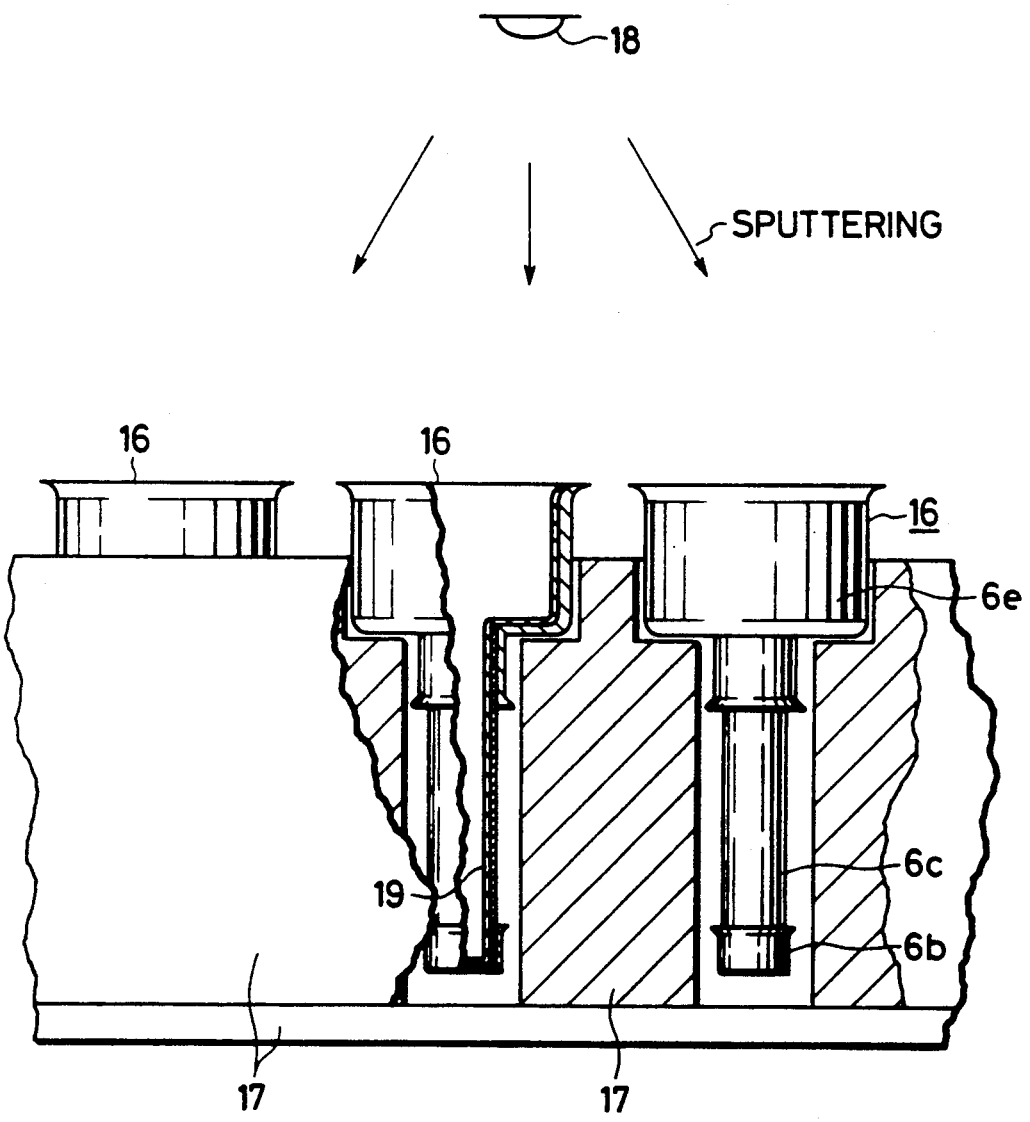
FIG. 3 is a cross-sectional plan view for explaining the indirectly heated cathode manufacturing method of the present invention.

FIG. 3 is a drawing for explaining the indirectly heated cathode manufacturing method of the present invention. In this method, the cathode assembly shown in FIG. 2 but not including heater 7, black coating **6*d* or electron-emissive material 6*a* is attached to jig 17, and set in a bell jar. Then sputtering of metals such as W, Ag, Ti and Mn is made from an evaporation source 18 to form a vacuum evaporation film 19 of oxides of the metals on at least the internal surface of cathode sleeve 6*c*. After obtaining the vacuum evaporation film 19, the cathode assembly 16 with the vacuum evaporation film 19 is taken out of the jig 17, and the vacuum evaporation film 19 is made into a black coating 6*d*** by heat treatment in vacuum during the manufacturing process of the cathode unit or the electron tube.

The manufacturing method of the present invention can also be employed for producing an indirectly heated cathode of well-known structure having a cap which is made of the same material as the cathode sleeve and which is made one body with the sleeve. In this case, the reducing material is also contained in the cap portion.

The preferred embodiments of the present invention will be explained in the following.

EMBODIMENT 1

A cathode assembly is assembled with a cathode sleeve made of Ni-Cr or Ni-Cr-Fe alloy containing about 20 wt % of Cr and, if necessary, several wt % of Fe (so-called nichrome alloy), a cap and a disk, both of which are attached to the sleeve. The cathode assembly is attached to a jig, and set in a bell jar to have a thin film of metal oxides deposited on the internal wall surface of the cathode sleeve by an evaporation method. In the bell jar, it is desirable for the deposition of the film, by the evaporation method, to take place in an atmosphere of Ar gas of $10^{-1}$ to 1 mm Hg, since the mean free path of the gas in the bell jar is required to be adequately smaller than the inside diameter of the sleeve. An atmosphere of $O_2$ may be used instead of Ar. Tungsten oxide is used as the evaporation source to be deposited by the evaporation method. The deposition of the tungsten oxide can be accomplished by any well known method. For example, pulverized tungsten oxide (having an average particle size of about 50 μm) is placed in a crucible of magnesia and heated to 1,400° to 1,500° C. by resistance heating or high frequency induction heating to make the tungsten oxide evaporate in the bell jar, whereby the evaporated tungsten oxide can be made to impinge against Ar and be deposited on the internal surface of the cathode sleeve. The thickness of the deposited film should be $10^3$ to $10^5$ Å. During this deposition process, it is necessary to prevent the tungsten oxide from depositing on the top surface of the cap where the electron-emissive material is to be deposited, since tungsten oxide deposited on that surface will react with the electron-emissive material to possibly cause exfoliation of the electron-emissive material.

Then, the cathode assembly with the film deposited by the evaporation method is taken out of the bell jar to allow the cathode assembly to undergo a process for deposition of an electron-emissive material on the top surface, by a known method, and subsequent processes for further treatment. The cathode assembly is then incorporated into a cathode ray tube by a known method. Subsequently, during the aging and the activation processes which are parts of the manufacturing process of the cathode ray tube, the chromium contained in the cathode sleeve and the deposited tungsten oxide film react with each other in the manner shown by the following chemical reaction formula to form a black film on the internal surface of the cathode sleeve.

$$Cr + WO_x \quad CrO_x + W$$

This process takes place in the vacuum, so that the atomic ratio between the oxygen and the chromium is at most 3, and the reaction progresses as shown by the above formula. As a result, the chromium oxide formed on the internal surface of the cathode sleeve turns a brown color while the metal tungsten turns black in color, whereby the emissivity increases.

EMBODIMENT 2

In this embodiment, a cathode assembly with a thin film of tungsten oxide ($10^3$ to $10^5$ Å thick) deposited on the internal surface of the cathode sleeve by the same method as that applied in embodiment 1 is put in a bell jar. Once inside of the bell jar vacuum at the pressures of $10^{-3}$ mm Hg or lower is applied, and the assembly is heated to 1000° C. for five minutes in the vacuum to form a black film on the internal surface of the cathode sleeve.

The cathode assembly is then subjected to a process for deposition of an electron-emissive material, and installed in a cathode ray tube by a known method. Cathode ray tubes produced by this method provide performance equal to that realized by the method of embodiment 1.

EMBODIMENT 3

In this embodiment, the tungsten particles at the dark portion of the heater, which is so-called a dark heater (For example, one defined in Japanese Patent Publication No. 39-3864) which has the black color of the surface of its insulating material, is preliminarily heated for oxidization at 400° C. in the air. This heater is combined with the cathode assembly having the construction similar to that defined in embodiment 1 but not provided with the film of tungsten oxide deposited on the internal surface of the cathode sleeve. The heater and the cathode assembly are then installed together in the cathode ray tube. A part of the tungsten oxide will sputter onto the internal surface of the cathode sleeve during ordinary aging and activation of the cathode ray tube. Then, the chemical reaction progresses in the manner similar to that stated in a embodiment 1 to form a black film on the internal surface of the cathode sleeve.

Materials such as Ag, Ti and Mn may be used in a manner similar to that of the tungsten oxide. Molybdenum may be used instead of chromium in the cathode sleeve.

As explained previously, in the manufacturing method of the indirectly heated cathode according to the present invention, the vacuum evaporation film of oxidized metal can be formed only or exclusively on the internal surface of the cathode sleeve by sputtering in a vacuum atmosphere to obtain an extremely high operation efficiency. The film can be preferentially deposited on the internal surface, the blackening of said deposited film can be easily accomplished during the manufacturing process of the cathode unit or the electron tube by the reaction between the film and the cathode sleeve composition, and the black film adheres so firmly on the internal surface of the cathode sleeve that there is no fear of having the film exfoliated or come off from the internal surface. Further, the thickness of the black film can be made to equal or less than $10^5$ Å, whereby the inside diameter of the cathode sleeve can be prevented from becoming too small and the adequate allowance can be given for design considerations. Furthermore, the perferential formation of the black film on the internal surface of the cathode sleeve enables emission warm up time for emission of electrons to be reduced by more than 0.5 second without increasing power consumption as compared with warm-up times from prior art methods. The top surface of the cap can be free from the deposition of the oxidized metal, thereby preventing the exfoliation or the removal of the electron-emissive material. In addition, the metallically shining external surface of the cathode sleeve radiates less heat than surfaces covered with black film, thus enabling suppression of the rise of temperature in the electron tube, prevention of the thermal transformation of the electrodes and prevention of the occurrence of stray emission.

What is claimed is:

1. A method of manufacturing an indirectly heated cathode comprising a cathode sleeve containing a reducing material; and a cap a top surface of which is covered with electron-emissive material and which is fixed to one end of said sleeve to cover said end; said method comprising preferentially forming a thin film of a metal oxide on only the internal surface of said cathode sleeve and heating to cause reduction of said thin film of the metal oxide by said reducing material.

2. A method of manufacturing an indirectly heated cathode according to claim 1, wherein said reducing material is selected from the group consisting of molybdenum and chromium.

3. A method of manufacturing an indirectly heated cathode according to claim 2, wherein said reducing material is chromium.

4. A method of manufacturing an indirectly heated cathode according to claim 1, wherein said metal oxide is selected from the group consisting of silver oxide, titanium oxide, manganese oxide and tungsten oxide.

5. A method of manufacturing an indirectly heated cathode according to claim 4, wherein said metal oxide is tungsten oxide.

6. A method of manufacturing an indirectly heated cathode according to claim 3, wherein said metal oxide is selected from the group consisting of silver oxide, titanium oxide, manganese oxide and tungsten oxide.

7. A method of manufacturing an indirectly heated cathode according to claim 6, wherein said metal oxide is tungsten oxide.

8. A method of manufacturing an indirectly heated cathode according to claim 1, wherein the thickness of said thin film of metal oxide is $10^3$ to $10^5$ Å.

9. A method of manufacturing an indirectly heated cathode according to claim 1, wherein said step of heating is the heating process of manufacturing an electron tube.

10. A method of manufacturing an indirectly heated cathode comprising a cathode sleeve, and a cap formed unitary with said sleeve of the same material, containing a reducing material, said cap having its top surface covered with electron-emissive material; said method comprising the steps of preferentially forming a thin film of a metal oxide on only the internal surface of said cathode sleeve and heating to cause reduction of said thin film of the metal oxide by said reducing material.

11. A method of manufacturing an indirectly heated cathode according to claim 10, wherein said reducing material is selected from the group consisting of molybdenum and chromium.

12. A method of manufacturing an indirectly heated cathode according to claim 11, wherein said reducing material is chromium.

13. A method of manufacturing an indirectly heated cathode according to claim 10, wherein said metal oxide is selected from the group consisting of silver oxide, titanium oxide, manganese oxide and tungsten oxide.

14. A method of manufacturing an indirectly heated cathode according to claim 13, wherein said metal oxide is tungsten oxide.

15. A method of manufacturing an indirectly heated cathode according to claim 12, wherein said metal oxide is selected from the group consisting of silver oxide, titanium oxide, manganese oxide and tungsten oxide.

16. A method of manufacturing an indirectly heated cathode according to claim 15, wherein said metal oxide is tungsten oxide.

17. A method of manufacturing an indirectly heated cathode according to claim 10, wherein the thickness of said thin film of metal oxide is $10^3$ to $10^5$ Å.

18. A method of manufacturing an indirectly heated cathode according to claim 10, wherein said step of heating is the heating process of manufacturing an electron tube.

* * * * *